United States Patent [19]

von der Eltz et al.

[11] 4,061,001

[45] Dec. 6, 1977

[54] DEVICE FOR THE APPLICATION OF FOAM ON TEXTILE WEBS

[75] Inventors: Hans-Ulrich von der Eltz, Frankfurt am Main; Erich Feess, Hofheim, Taunus; Siegfried Glander, Bad Soden, Taunus, all of Germany

[73] Assignee: Hoechst Aktiengesellschaft, Frankfurt am Main, Germany

[21] Appl. No.: 688,896

[22] Filed: May 21, 1976

[30] Foreign Application Priority Data

May 24, 1975 Germany ..... 2523062

[51] Int. Cl.[2] ..... D06B 1/08

[52] U.S. Cl. ..... 68/200; 118/413; 118/415; 118/612; 261/DIG. 26; 366/337

[58] Field of Search ..... 118/410, 411, 412, 413, 118/415, 600, 612; 427/373; 156/78, 79; 425/4 C; 260/2.5 BC; 261/DIG. 26; 68/200, 205 R, 175, 181 R; 259/4 R, 60, 4 AB, 4 AC

[56] References Cited

U.S. PATENT DOCUMENTS

| | | | |
|---|---|---|---|
| 2,992,627 | 7/1961 | Ring | 118/413 |
| 3,522,069 | 7/1970 | Checko et al. | 427/373 X |
| 3,610,201 | 10/1971 | Meyer | 118/410 X |
| 3,628,503 | 12/1971 | Neuhaus et al. | 118/410 |
| 3,697,314 | 10/1972 | Stritzko | 118/411 X |
| 3,913,359 | 10/1975 | Childers et al. | 68/207 X |
| 3,969,780 | 7/1976 | Henderson | 68/205 R X |

FOREIGN PATENT DOCUMENTS

| | | | |
|---|---|---|---|
| 453,230 | 9/1936 | United Kingdom | 118/413 |

*Primary Examiner*—Philip R. Coe
*Attorney, Agent, or Firm*—Curtis, Morris & Safford

[57] ABSTRACT

Device for the uniform application of liquid treating baths in the form of foam onto textile flat materials, consisting essentially of (a) elements for foaming the liquor under pressure, by a pipe-line for the foam linked to (b) a foam distributing and foam applying chamber, and immediately below, but not directly limited therewith, (c) elements for supporting and transporting the textile web in open width of the material.

5 Claims, 5 Drawing Figures

3b
3a
7b
10
6
9
8
5
1
4
7a
11
3b
2

17
11
12
16
15
15
14
14
14
22
16
18
19
22

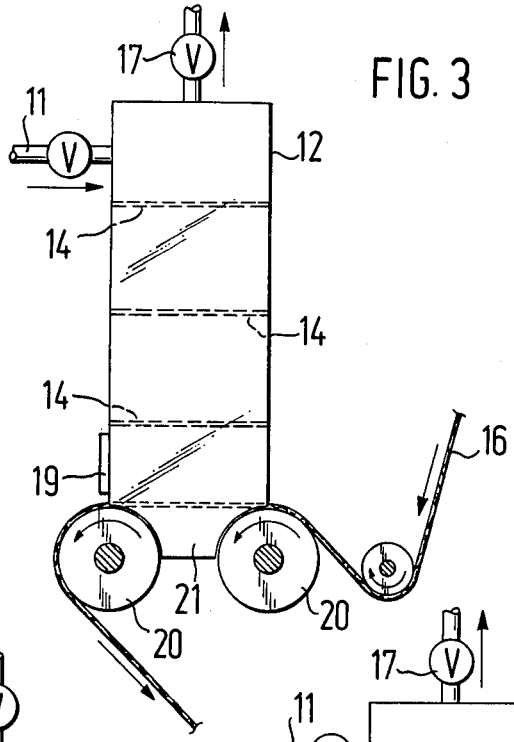
FIG. 3
FIG. 4
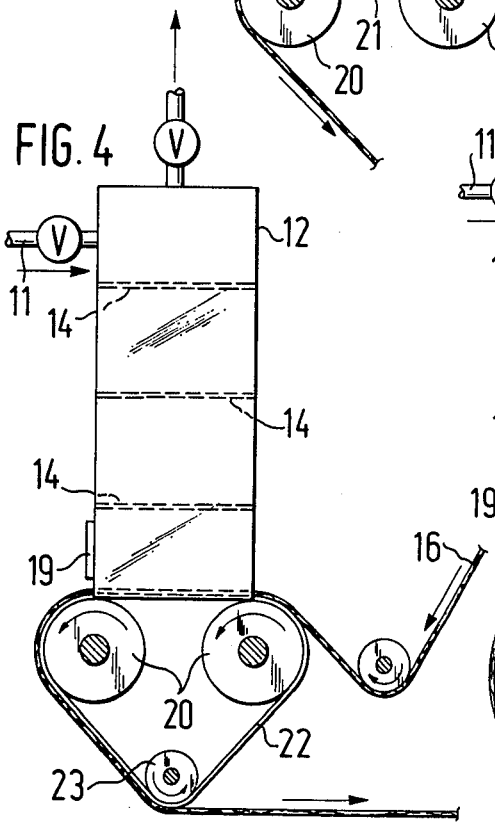
FIG. 5
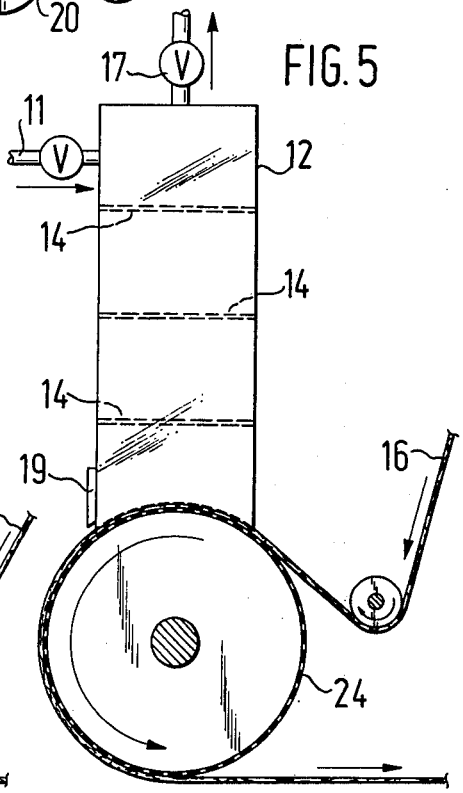

DEVICE FOR THE APPLICATION OF FOAM ON TEXTILE WEBS

The present invention relates to a device for the uniform application of liquid treating baths in the form of foam onto textile flat materials, consisting essentially of a. elements for foaming the liquor under pressure, comprising a mixing chamber constructed as foam producer, with separate inlets for pressurized air, and the liquor supplied from a storage vessel; each of the two feeding pipes contain devices for measuring the amounts for the corresponding medium as well as corresponding reducing valves. by a pipe-line for the foam formed linked to b. a foam distributing and foam applying chamber having a rectangular open base, to the long side edge of which a movable doctor blade is attached, and which contain laterally staggered baffle plates one below the other and spaced overlappingly, and at the small sides movable limiting plates for a variable adjustment of the active foam application surface depending on the width of the material web, and immediately below, but not directly limited therewith, c. elements for supporting and transporting the textile web in open width of the material The device described especially serves for the uniform and thin layer application (20 to 30% by weight, calculated on the weight of the dry textile web) of foamed fixing chemicals in the second phase of the twophase printing process for reactive dyestuffs for example.

By this way considerable amounts of inorganic salts are saved, which otherwise are added in the scope of the hitherto usual fixation processes during padding, slop-padding etc., in order to avoid a migration of the prints. When using the conventional working methods these salts in excess have to be washed out again, charging, thus, the sewage water. The use of the device described above thus reduces the consumption of chemicals and the amounts of fresh water required.

The application of foamed dyeing liquor replaces the foulard. With the device described there may even be achieved special tinctorial effects which are impossible with the padding method. According to position and shape of the doctor knife there may be produced shading and wave designs in a direction transverse to the material web. A division of the chamber into separate compartments with separate foam inlets allows to apply multicolor foams one beside the other and to dye stripes.

The structure and function of the device described above is illustrated diagrammatically by way of Example by the accompanying drawings:

FIG. 3 is a side elevational view of the foam distributing chamber of FIG. 2; and FIGS. 4 and 5 are side elevational views similar to FIG. 3 of another embodiment of the invention showing further types of facilities for transporting textile webs.

Figure 1:
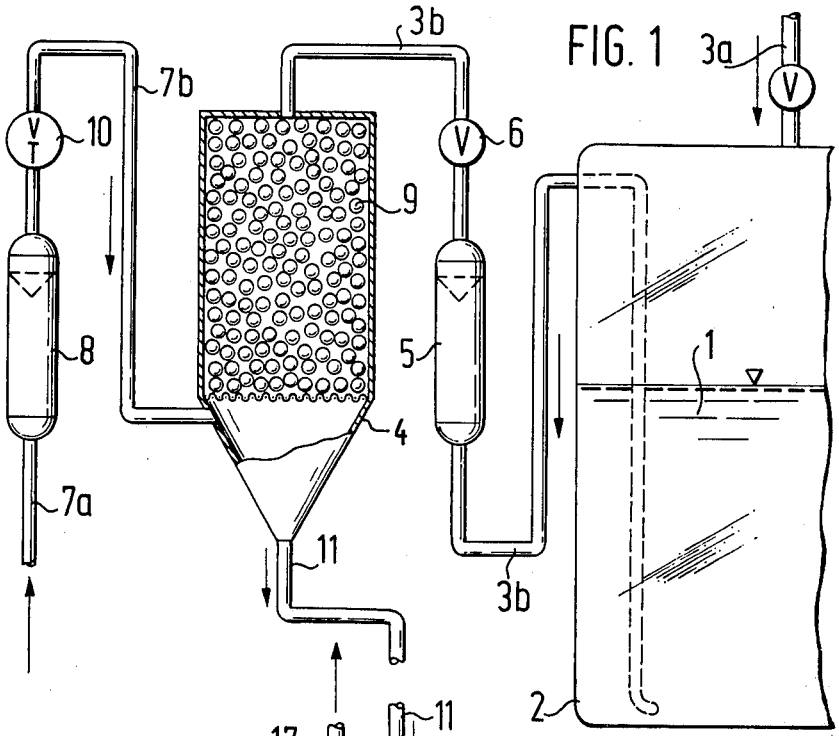
FIG. 1 is a schematic elevational view, with parts broken away, of a portion of the apparatus of the present invention.

According to FIG. 1, which illustrates the equipment for the foaming of the liquor, the liquor to be foamed 1 is in a closed storage vessel 2: from there it is pressed via a pipeline *3b* into the mixing chamber 4 by means of a constant excess pressure, for example about 2 atmospheres gage, directed to the liquid surface by the feeding pipe *3a*. During this operation the amount of liquid transported is indicated by a flow meter 5 and can be controlled by a valve 6 manually or automatically depending on the transport speed of the material. The supply of the liquid to the mixing chamber 4 may also be effected from an open storage vessel by means of a geared pump. Parallel to the supply with the treating liquor the measuring device 8 indicates the amount of pressurized air which is introduced from the inlet *7a* into the system and which, pressed via a pipeline *7b* after entering the mixing chamber 4, leads to the foaming of the liquor flowing down many small glass balls 9. The enlargement of the surface of the bath by these balls 9 is also used in the case of foam fire extinguishers. The amount of air supplied may be regulated over a throttle 10, so that expediently a 3 to 8% foam is formed (for example, 6% by volume of a bath and 94% by volume of air). Then the foam formed leaves the mixing chamber 4 via a pipe-line 11 in the direction of the foam applying device (FIG. 2).

Figure 2:
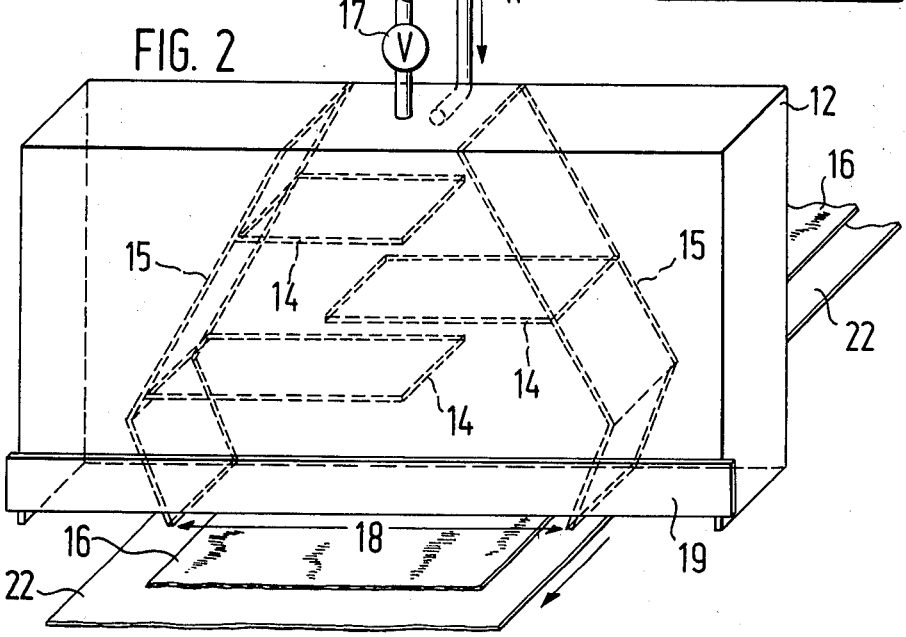
FIG. 2 is a partial perspective view of the foam distributing chamber of the apparatus of the present invention demonstrating one type of guidance of the textile material.

FIG. 2 represents a foam-distributing and foam-applying chamber consisting of a box 12 into which the foam formed enters through the pipe 11. In this box there are attached staggered baffle plates 14 which ensure a better distribution of the foam over the whole efficient width of the box. FIG. 2 shows the spaced overlapping of these plates 14 which permit an adjustable arrangement of the lateral limiting plates 15 according to the width of the textile web 16. During the filling phase of the box 12 with foam a valve 17 can be opened on the box 12 to allow the air displaced by the foam to escape.

The rectangular bottom of the box 12 is designed as a surface-like opening and represents the place where foam and textile material 16 come into contact. The material web passes below this opening and is treated during this phase with the foamed liquid.

The device described permits a regular application of the foam onto textiles having different widths and different transport speeds. Limiting plates 15 mounted at both sides in the interior of the box 12, which may be displaced towards the middle take care that the efficient foam-applying surface 18 is adjusted according to the width of the material web.

The amount of foam applied is determined by the pressure exerted to the foam and by the height of the doctor blade 19 mounted at the lower end of the one long side edge of the box 12. The foam layer penetrating the textile material 16 depends above all, with regard to the thickness thereof, on the clearance between the material surface and the doctor blade 19. Different positions or shapes of the doctor blade during the treatment of the material with foam permit in the case of the dyeing operation the formation of the dyeing effects mentioned above. For example, an inclined position of the doctor blade provides a shaded dyeing from one edge of the material web to the other. The doctor blade may also be moved up and down by a cam spindle and, thus, cause shadings on the dyed textile material in the transport direction.

At the inlet edge of the box 12 and the lateral limiting plates 15, stripes, for example of rubber, are attached which rest on the material or support (see the different possibilities according to FIGS. 3 and 5). In this manner the foam can leave the box 12 only in the transport direction of the material towards the front under the doctor knife 19. In some cases, for example in the plain dyeing, it may be done without a certain foam layer to leave the doctor blade; i.e. the foam is completely held back by the doctor knife 19. The amount of foam contacting the textile material is then varied by changing the length of the foam contact area in the box 12.

According to the most frequent speeds of the material and the weights of the textile webs, different supports may be used for the foam distributor. The foam application box 12 may be based, for example, on two parallel arranged rollers 20, around which the material web is conducted (FIG. 3). The nip between these rollers 20 is provided with wedgeshaped elements 21 coming from both sides reaching the edges of the material web and the lateral rubber strips mentioned above preventing the foam to escape towards the side edges. The two rollers 20 may also be contacted with an endless cover 22, for example a conveyor belt of rubber, foil or network, which is contacted and driven on by a third roller 23 (FIG. 4). A further possibility (FIG. 5) for supporting consists in putting the box 12 on a sieve drum 24. When using very heavy material the pressure in this sieve drum 24 may be reduced in order to achieve a better soaking of the textile material.

We claim:

1. A device for the application of a liquid treating bath in the form of a foam onto flat textile materials comprising, a storage vessel for containing liquor to be foamed, mixing chamber means for producing foam from said liquor, a first pipeline connecting said storage vessel to said mixing chamber means for supplying liquor to the mixing chamber means, a second pipeline connected to said mixing chamber means for supplying air under pressure to said mixing chamber means; means in each pipeline for respectively measuring the amount of liquor and air flowing therein, and reducing valves respectively connected to said pipelines for respectively controlling liquor and air flow therethrough.

a foam distributing and supplying chamber, a third pipeline connecting said mixing chamber means to said distributing chamber to supply foam to the distributing chamber; said distributing chamber having an open rectangular base through which the foam is discharged; said base having a pair of parallely extending long sides and a pair of parallely extending short sides adjacent said open base; a doctor blade adjustably mounted on said base along one of said long sides; a plurality of laterally staggered vertically spaced, overlapping baffle plates mounted in said distributing chamber; a pair of movably mounted spaced side plates in said distributing chamber extending generally perpendicularly to said one long side defining a variable foam discharge opening from the distributing chamber, and means below said distributing chamber and said foam discharge opening for supporting and transporting a textile web below said foam discharge opening to allow application of the foam to the web.

2. A device claimed in claim 1, wherein said supporting and transporting means comprises two rollers, around which the material web is conducted.

3. A device as claimed in claim 1, wherein said supporting and transporting means comprises an endless conveyor belt.

4. A device as claimed in claim 1, wherein said supporting and transporting means comprises a sieve drum.

5. A device for the application of a liquid treating bath in the form of a foam onto flat textile materials comprising, a liquid storage vessel, mixing chamber means communicating with said storage vessel to receive liquid therefrom, means for forming foam from said liquid in said mixing chamber, a foam distributing chamber associated with said mixing chamber for receiving foam therefrom and including an open lower end, a doctor blade mounted on said distributing chamber along said lower end thereof, a plurality of laterally staggered vertically spaced overlapping baffle plates mounted in said distributing chamber above said lower end for receiving foam from the mixing chamber and distributing the foam within the distributing chamber; means in said distributing chamber for defining a variably dimensioned foam discharge opening at said lower open end of the distributing chamber; and means located below said discharge opening for supporting and transporting a textile web below said foam discharge opening to allow application of foam to the web.

* * * * *